US008986171B2

(12) United States Patent
Feng et al.

(10) Patent No.: US 8,986,171 B2
(45) Date of Patent: Mar. 24, 2015

(54) BOXING GAME MACHINE

(71) Applicants: Feiloli Electronic Co., Ltd., Changhua (TW); Department of Electrical Engineering, National Changhua University of Education, Changhua (TW)

(72) Inventors: Shen Te Feng, Changhua (TW); Chi-Ming Tsai, Changhua (TW); Tsair-Rong Chen, Changhua (TW); Yu-Lin Juan, Changhua (TW)

(73) Assignees: Feiloli Electronic Co., Ltd., Changhua (TW); Department of Electrical Engineering, National Changhua University of Education, Changhua (TW)

( * ) Notice: Subject to any disclaimer, the term of this patent is extended or adjusted under 35 U.S.C. 154(b) by 108 days.

(21) Appl. No.: 13/910,003

(22) Filed: Jun. 4, 2013

(65) Prior Publication Data

US 2014/0357455 A1 Dec. 4, 2014

(51) Int. Cl.
*A63B 21/00* (2006.01)
*A63B 69/20* (2006.01)

(52) U.S. Cl.
CPC ..... *A63B 69/205* (2013.01)
USPC ..... 482/83; 482/87; 482/90

(58) Field of Classification Search
USPC ..... 482/83, 87, 90
See application file for complete search history.

(56) References Cited

U.S. PATENT DOCUMENTS

| | | | | |
|---|---|---|---|---|
| 4,093,212 | A * | 6/1978 | Jacques | 482/83 |
| 4,512,568 | A * | 4/1985 | Servadio | 482/4 |
| 7,704,194 | B1 * | 4/2010 | Chen | 482/87 |
| 2004/0209743 | A1 * | 10/2004 | Perez | 482/83 |
| 2007/0093362 | A1 * | 4/2007 | Clayton | 482/88 |

* cited by examiner

*Primary Examiner* — Jerome W Donnelly

(57) ABSTRACT

A boxing game machine includes a punch bag, a frame, a rocker, a catch, a latch and a spring. The rocker is pivotally connected to the frame between an idle position and an active position. The punch bag is secured to an end of the rocker. The catch is secured to another end of the cocker and formed with a radial edge. The latch is movably supported on the frame and formed with an edge for sliding into contact with radial edge of the catch so that the latch engages with the catch. The spring biases the latch into engagement with the catch to keep the rocker in the idle position.

17 Claims, 6 Drawing Sheets

BOXING GAME MACHINE

BACKGROUND OF INVENTION

1. Field of Invention

The present invention relates to boxing and, more particularly, to a boxing game machine.

2. Related Prior Art

There have been various boxing game machines. A boxing game machine includes a punch bag for swing between an idle position and an active position and an apparatus for holding the punch bag in the idle position before a token is tossed in the boxing game machine. The apparatus releases the punch bag into the active position from the idle position after a token is tossed in the boxing game machine. The punch bag is returned into the idle position from the active position after it is punched. The apparatus is supposed to hold the punch bag in the idle position. However, in the case of a strong punch on the punch bag, the punch back could bounce back into the active position from the idle position before the apparatus could effectively hold the punch bag in the idle position.

The present invention is therefore intended to obviate or at least alleviate the problems encountered in prior art.

SUMMARY OF INVENTION

It is the primary objective of the present invention to provide a reliable boxing game machine.

To achieve the foregoing objective, the boxing game machine includes a punch bag, a frame, a rocker, a catch, a latch and a spring. The rocker is pivotally connected to the frame between an idle position and an active position. The punch bag is secured to an end of the rocker. The catch is secured to another end of the cocker and formed with a radial edge. The latch is movably supported on the frame and formed with an edge for sliding into contact with radial edge of the catch so that the latch engages with the catch. The spring biases the latch into engagement with the catch to keep the rocker in the idle position.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
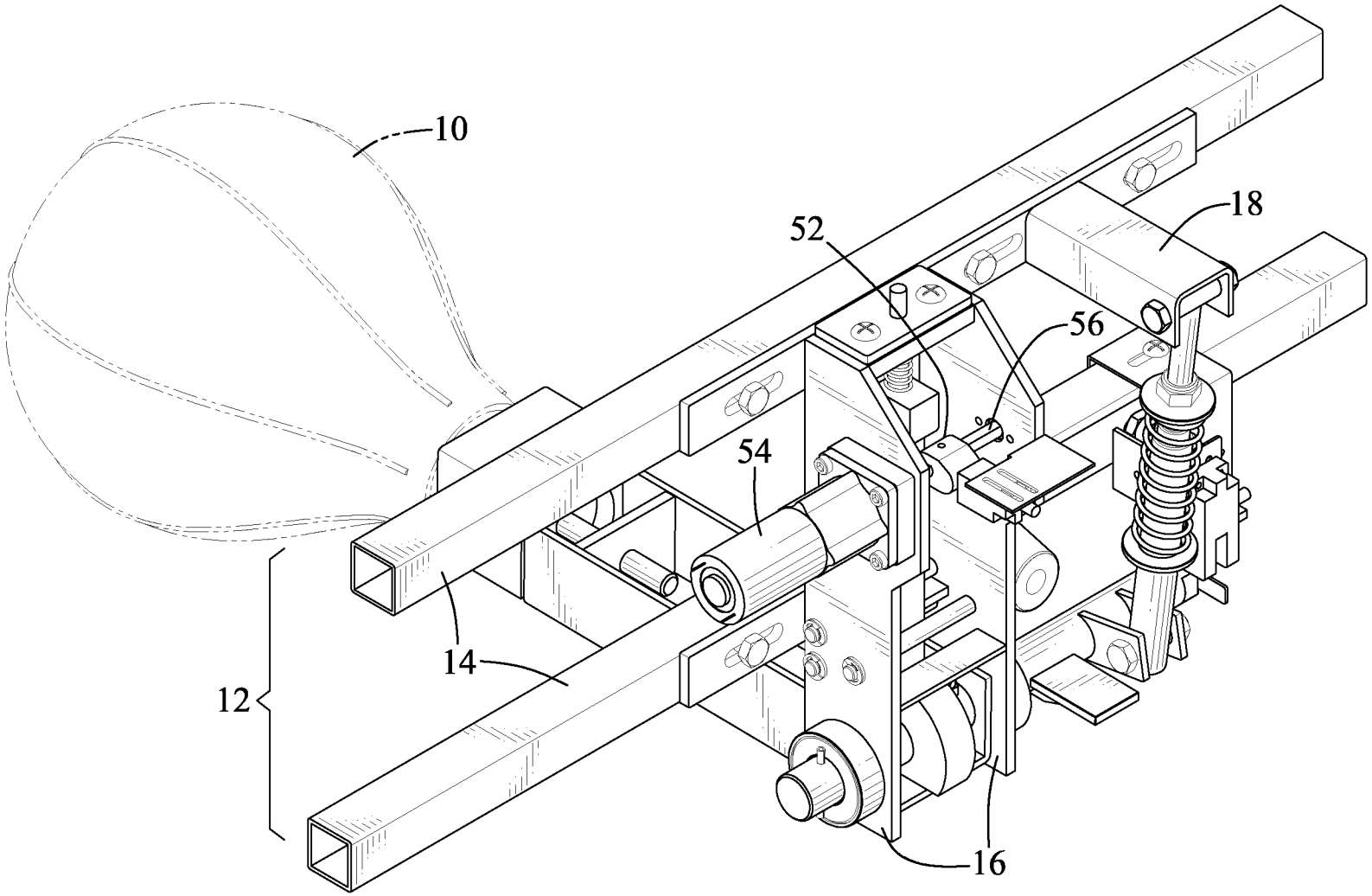
FIG. 1 is a perspective view of a boxing game machine in an idle position according to the preferred embodiment of the present invention.
Figure 2:
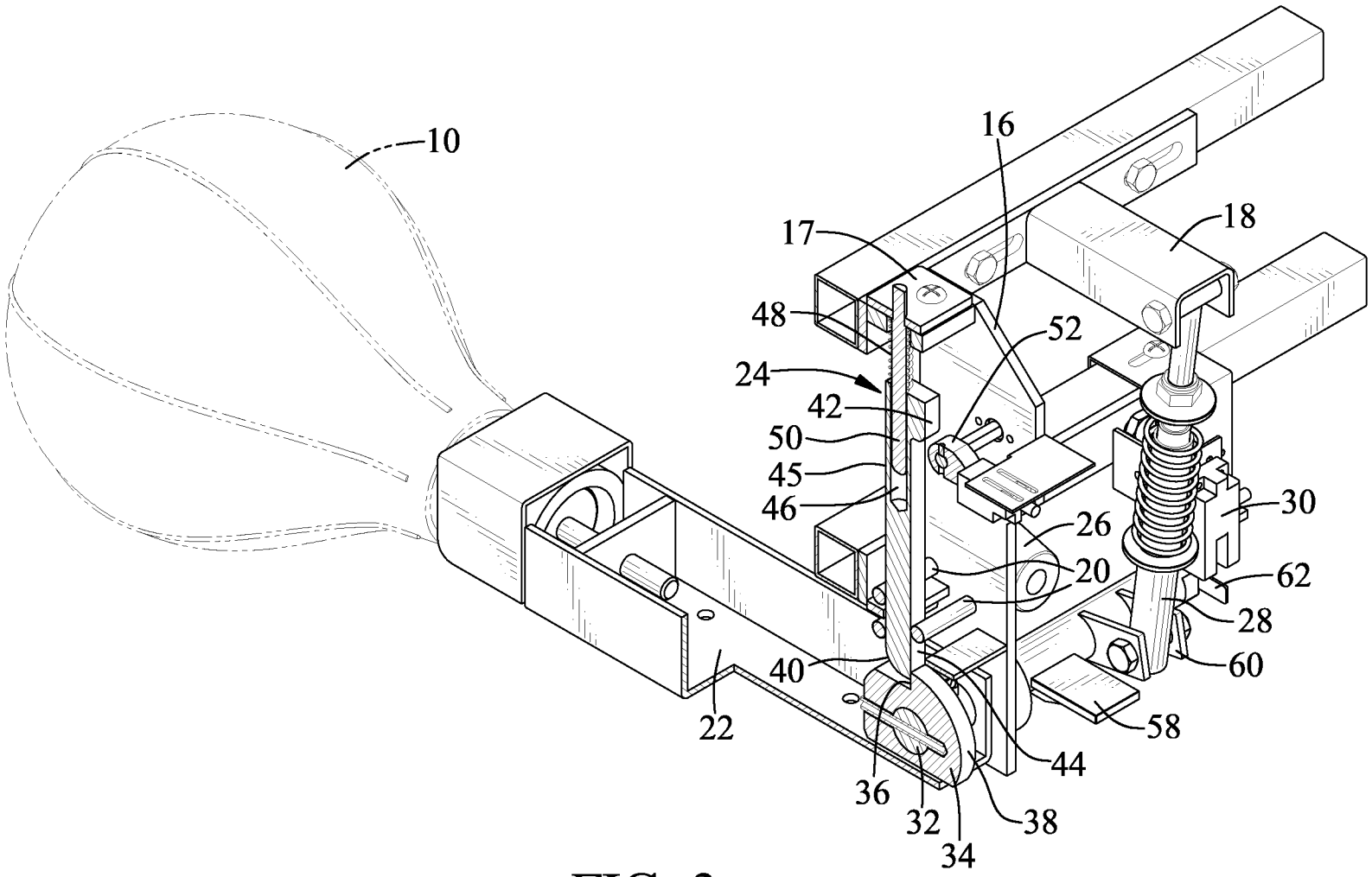
FIG. 2 is a cut-away view of the boxing game machine shown in FIG. 1.
Figure 3:
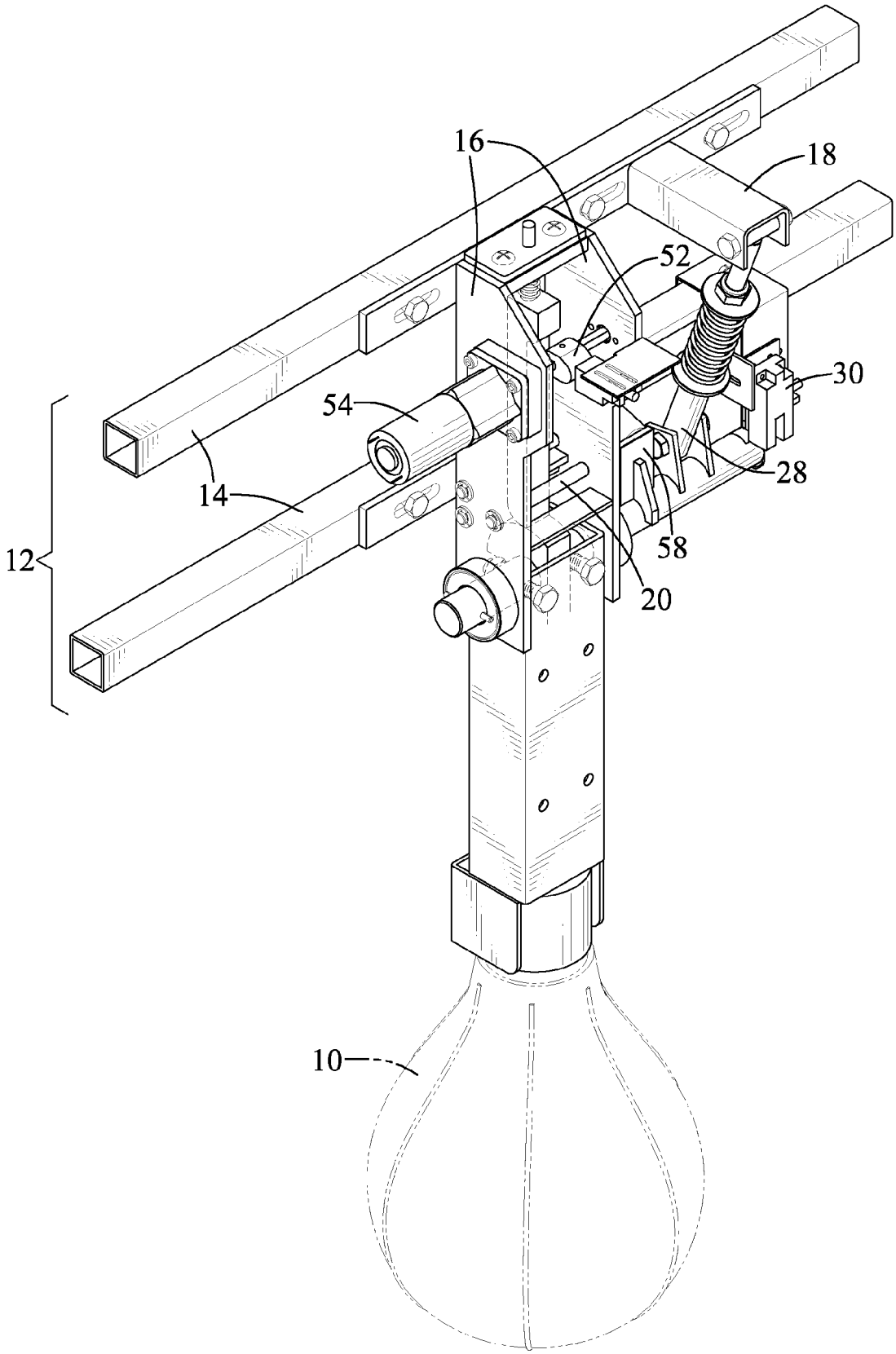
FIG. 3 is a perspective view of the boxing game machine in an active position different from the idle position shown in FIG. 1.

Referring to FIGS. 1 through 3, there is shown a boxing game machine in accordance with the preferred embodiment of the present invention. The boxing game machine includes a punch bag 10 connected to a frame 12. The punch bag 10 is movable between an idle position as shown in FIG. 1 and an active position as shown in FIG. 3. After tossing a token in the boxing game machine, a player is supposed to punch the punch bag 10 hard enough to send the punch bag 10 into the idle position from the active position. The boxing game machine is supposed to keep the punch bag 10 in the idle position before another token is tossed therein.

The frame 12 includes upper and lower beams 14, two walls 16, a plate 17, a rod 18 and three guiding elements 20. The walls 16 are secured to the upper and lower beams 14. The plate 17 is secured to the upper beam 14, between the walls 16. The rod 18 is secured to the upper beam 14. The guiding elements 20 are connected to the walls 16. Two of the guiding elements 20 are arranged along a vertical line from which the other guiding element 20 is biased.

The boxing game machine includes a rocker 22, a latch 24, a buffer 26, a cushion 28 and a sensor 30 in addition to the frame 12. The rocker 22 is pivotally connected to the walls 16 by a shaft 32. The punch bag 10 is secured to an end of the rocker 22. A catch 34 is secured to another end of the rocker 22. Moreover, the catch 34 is rotationally connected to the walls 16 by the shaft 32. The catch 34 is formed with a radial edge 36 and an arched edge 38.

The latch 24 is formed with a chamfer 40, a tab 42, a major edge 44, a minor edge 45 and a cave 46. The chamfer 40 is formed at a first end of the latch 24. The tab 42 extends transversely from a second end of the latch 24. The major edge 44 extends parallel to the minor edge 45. The tab 42 is located at an upper end of the major edge 44. The chamfer 40 is located at a lower end of the minor edge 45. The cave 46 is defined in the second end of the latch 24. The latch 24 is placed above the catch 34.

One of the guiding elements 20 is in contact with the major edge 44 of the latch 24 while the other guiding elements 20 contact the minor edge 45 of the latch 24. Therefore, the latch 24 is guided by the guiding elements 20, which together together form a guiding device.

A spring 48 is compressed between the latch 24 and the plate 17. The latch 24 is biased toward the catch 34 by the spring 48, which is placed against the plate 17. A bar 50 is inserted in the cave 46, the spring 48 and an aperture defined in the plate 17. Therefore, the spring 48 is positioned by the bar 50.

A cam 52 is connected to a motor 54 by an axle 56 that is supported on the walls 16. The cam 52 is placed between the walls 16. The motor 54 is secured to one of the walls 16. The cam 52, the motor 54 and the axle 56 together form a moving device.

The buffer 26 is secured to the lower beam 14. The buffer 26 is an elastic block made of rubber or plastics for example.

A tab 58 is secured to the shaft 32. The tab 58 is brought into contact with the buffer 26 as the punch bag 10 gets near the active position. Thus, the rotation of the shaft 32 is buffered and stopped, and so is the drop of the punch bag 10.

Two cranks 60 are secured to the shaft 32. An end of the cushion 28 is placed between and connected to the cranks 60. Another end of the cushion 28 is connected to the rod 18. The cushion 28 is compressed between the cranks 60 and the rod 18 during the drop of the punch bag 10 to the active position. Thus, the rotation of the shaft 32 is damped by the cushion 28, and so is the drop of the punch bag 10. Preferably, the cushion 28 includes a helical spring placed around a hydraulic or pneumatic cylinder.

The sensor 30 is secured to the lower beam 14. An indicator 62 is secured to the shaft 32. Preferably, the sensor 30 is an optical sensor that includes an emitter and a receiver and the indicator 62 is an opaque tab. The indicator 62 is brought into the gap between the emitter and the receiver as the punch bag 10 reaches the active position. Thus, the indicator 62 interrupts the communication of light between the emitter and the receiver. On sensing the indicator 62, the sensor 30 sends a signal for controlling the motor 54. The sensor 30 and the indicator 62 together form a sensing device.

Figure 4:
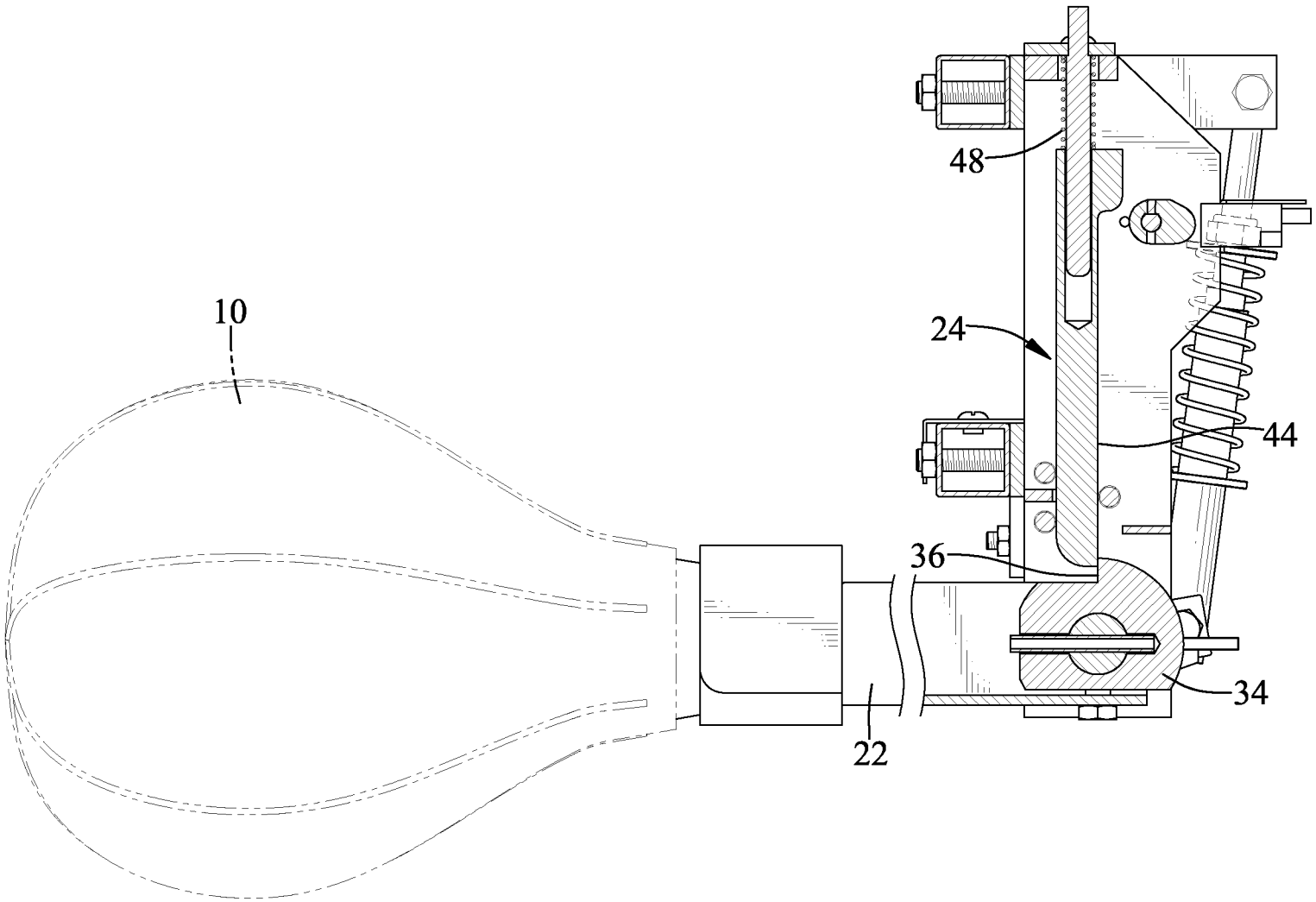
FIG. 4 is a side view of the boxing game machine shown in FIG. 1.

Referring to FIG. 4, the punch bag 10 is in the idle position. The radial edge 36 of the catch 34 is placed against the major edge 44 of the latch 24, which is biased toward the catch 34 by the spring 48. Thus, the rocker 22 is kept in a horizontal position and the punch bag 10 is retained in the idle position.

Figure 5:
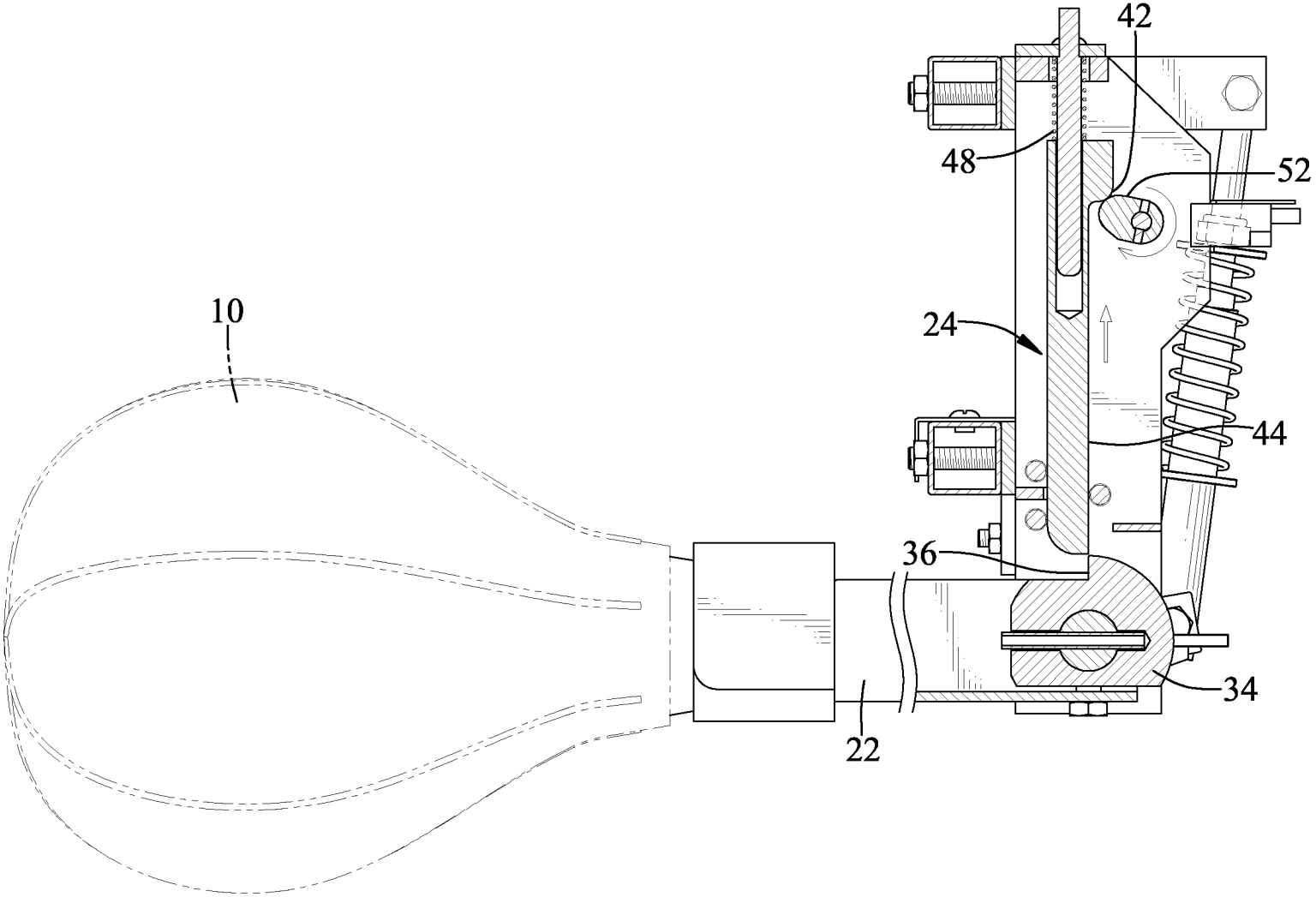
FIG. 5 is a side view of the boxing game machine in another position than shown in FIG. 4.

Referring to FIG. 5, after a token is inserted in the boxing game machine, the motor 54 is turned on to rotate the cam 52 to push the tab 42 upward. Thus, the latch 24 is lifted while the spring 48 is loaded. Accordingly, the major edge 44 of the latch 24 is moved out of the radial edge 36 of the catch 34. Hence, the rocker 22 is allowed to pivot from the horizontal position. That is, the punch bag 10 is allowed to fall from the idle position.

Figure 6:
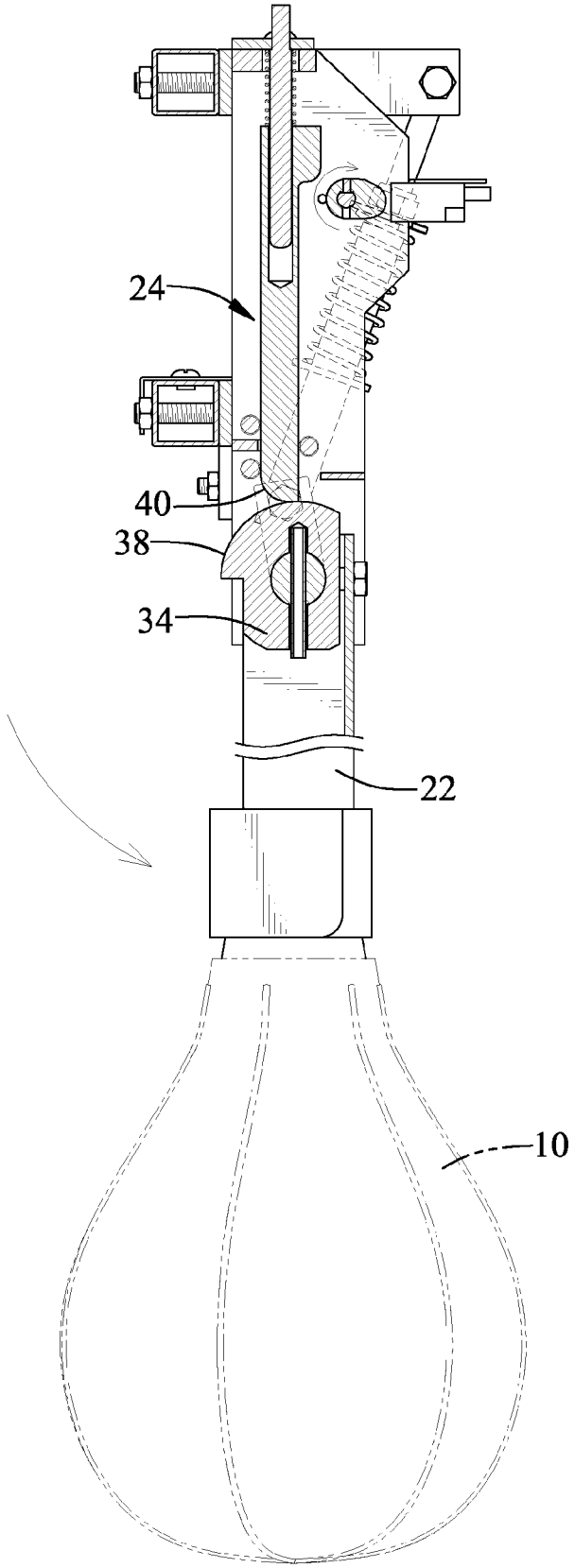
FIG. 6 is a side view of the boxing game machine shown in FIG. 3.

Referring to FIG. 6, the punch bag 10 is in the active position. The punch bag 10 can be punched. The punch bag 10 is supposed to swing back to the idle position after it is punched. The arched edge 38 slides on the chamfer 40 so that the rotation of the catch 34 is not considerably hindered by the latch 24.

Advantageously, the spring 48 pushes the latch 24 toward the catch 34 to cause the major edge 44 of the latch 24 to abut against the radial edge 36 of the catch 34 as soon as the punch bag 10 reaches the idle position. Thus, the rocker 22 is effectively kept in the horizontal position and the punch bag 10 is firmly retained in the idle position.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A boxing game machine including:

a frame;

a rocker pivotally connected to the frame between an idle position and an active position;

a punch bag secured to an end of the rocker;

a catch secured to another end of the cocker and formed with a radial edge;

a latch movably supported on the frame and formed with a major edge for sliding into contact with radial edge of the catch so that the latch engages with the catch; and a spring for biasing the latch into engagement with the catch to keep the rocker in the idle position.

2. The boxing game machine according to claim 1, wherein the catch is formed with an arched edge, wherein the latch includes a chamfer for sliding on the arched edge of the catch so that the rocker smoothly swings into the idle position from the active position.

3. The boxing game machine according to claim 1, including a guiding device for guiding the latch to move smoothly.

4. The boxing game machine according to claim 3, wherein the latch includes a minor edge extending parallel to the major edge, wherein the guiding device includes at least one guiding element in contact with one of the edges of the latch and two more guiding elements in contact with the other edge of the latch.

5. The boxing game machine according to claim 1, including a bar secured to the frame and inserted in the spring.

6. The boxing game machine according to claim 5, wherein the latch includes a cave for receiving an end of the bar.

7. The boxing game machine according to claim 6, wherein the frame includes a plate connected to another end of the bar.

8. The boxing game machine according to claim 7, wherein the spring is compressed between the plate and the latch.

9. The boxing game machine according to claim 1, including a moving device for moving the latch from the catch.

10. The boxing game machine according to claim 9, wherein the latch is formed with a tab, wherein the moving device includes a cam for contacting and pushing the tab.

11. The boxing game machine according to claim 1, including a shaft for supporting the catch on the frame.

12. The boxing game machine according to claim 11, including a tab connected to the shaft and a buffer connected to the frame, wherein the buffer contacts the tab as the rocker reaches the active position.

13. The boxing game machine according to claim 11, including a crank connected to the shaft and a cushion formed with an end connected to the crank and another end connected to the frame , wherein the cushion is compressed during the entire pivoting of the rocker into the active position from the idle position.

14. The boxing game machine according to claim 13, wherein the frame includes a rod formed with an end connected thereto and another end connected to the cushion.

15. The boxing game machine according to claim 11, including a sensing device for sensing the rocker in the active position.

16. The boxing game machine according to claim 15, wherein the sensing device includes an indicator connected to the shaft and a sensor for sensing the indicator.

17. The boxing game machine according to claim 16, wherein the sensor is an optical sensor, wherein the indicator is an opaque tab.

* * * * *